US008624527B1

(12) United States Patent
Meir et al.

(10) Patent No.: US 8,624,527 B1
(45) Date of Patent: Jan. 7, 2014

(54) INDEPENDENTLY CONTROLLABLE ILLUMINATION DEVICE

(75) Inventors: Noam Meir, Hezlia (IL); Ilan Landsmann, Ramat Gan (IL); Ori Spier, Nachsholim (IL); Tania Kosburd, Lod (IL); Eran Fine, Tel-Aviv (IL)

(73) Assignee: Oree, Inc., Ramat Gan (IL)

( * ) Notice: Subject to any disclaimer, the term of this patent is extended or adjusted under 35 U.S.C. 154(b) by 852 days.

(21) Appl. No.: 12/749,083

(22) Filed: Mar. 29, 2010

Related U.S. Application Data

(60) Provisional application No. 61/163,988, filed on Mar. 27, 2009.

(51) Int. Cl.
*H05B 37/00* (2006.01)

(52) U.S. Cl.
USPC ..... 315/318; 315/312; 315/297; 315/294; 315/291; 315/149; 340/870.04; 340/870.17

(58) Field of Classification Search
USPC ..... 315/149, 158, 224, 294, 297, 307–309, 315/312, 318, 360, 291; 340/870.04, 340/870.15, 870.17, 870.18, 870.24
See application file for complete search history.

(56) References Cited

U.S. PATENT DOCUMENTS

| | | | |
|---|---|---|---|
| 3,261,356 | A | 7/1966 | Wallace |
| 3,626,471 | A | 12/1971 | Florin |
| 3,871,747 | A | 3/1975 | Andrews |
| 3,995,934 | A | 12/1976 | Nath et al. |
| 4,551,129 | A | 11/1985 | Coleman et al. |
| 4,669,467 | A | 6/1987 | Willett et al. |
| 4,714,983 | A | 12/1987 | Lang |
| 4,762,381 | A | 8/1988 | Uemiya et al. |
| 4,783,140 | A | 11/1988 | Osawa et al. |
| 4,829,192 | A | 5/1989 | Kokubu et al. |

(Continued)

FOREIGN PATENT DOCUMENTS

| | | |
|---|---|---|
| CN | 2593229 | 12/2003 |
| CN | 1321344 | 6/2007 |

(Continued)

OTHER PUBLICATIONS

Allen et al., "A nearly ideal phosphor-converted white light-emitting diode" *Appl. Phys. Ltrs*. 92: 143309 (2008).

(Continued)

*Primary Examiner* — Haiss Philogene
(74) *Attorney, Agent, or Firm* — Bingham McCutchen LLP

(57) ABSTRACT

An illumination system in accordance with an embodiment hereof includes a plurality of LED units, a system controller, at least one sensing unit, and a plurality of local controllers each associated with at least one LED unit. Each LED unit includes a plurality of differently colored, independently controllable LEDs forming a color gamut. The system controller generates control signals for each of the LED units consistent with a desired system-level output. The sensing unit(s) senses an operating state of the LEDs during operation thereof, and each local controller includes a memory and a compensator. The memory includes calibration data for use over a short time period, and the compensator updates the calibration data based on measurements from a sensing unit over a long time period. Based at least in part on the calibration data, the local controller operates the LEDs of the LED unit to maintain output intensities consistent with commands issued by the system controller.

24 Claims, 6 Drawing Sheets

(56) References Cited

U.S. PATENT DOCUMENTS 4,853,593 A 8/1989 Stein et al.
4,872,837 A 10/1989 Issalene et al.
4,878,072 A 10/1989 Reinten
4,903,172 A 2/1990 Schoniger et al.
4,906,062 A 3/1990 Young et al.
5,048,913 A 9/1991 Glenn et al.
5,061,032 A 10/1991 Meltz et al.
5,139,420 A 8/1992 Walker
5,152,686 A 10/1992 Duggan et al.
5,165,187 A 11/1992 Shahidi-Hamedani et al.
5,211,467 A 5/1993 Seder
5,281,134 A 1/1994 Schultz
5,425,730 A 6/1995 Luloh
5,535,105 A 7/1996 Koenen et al.
5,559,358 A 9/1996 Burns et al.
5,569,254 A 10/1996 Carlson et al.
5,580,154 A 12/1996 Coulter et al.
5,675,678 A 10/1997 Neuberger et al.
5,718,666 A 2/1998 Alarcon
5,813,752 A 9/1998 Singer et al.
5,813,753 A 9/1998 Vriens et al.
5,847,507 A 12/1998 Butterworth et al.
5,899,552 A 5/1999 Yokoyama et al.
5,947,588 A 9/1999 Huang
5,959,316 A 9/1999 Lowery
5,969,869 A 10/1999 Hirai et al.
6,016,038 A 1/2000 Mueller et al.
6,031,511 A 2/2000 DeLuca et al.
6,079,838 A 6/2000 Parker et al.
6,097,871 A 8/2000 De Dobbelaere et al.
6,155,699 A 12/2000 Miller et al.
6,226,440 B1 5/2001 Lyons
6,275,512 B1 8/2001 Fermann
6,278,106 B1 8/2001 Muto et al.
6,322,225 B1 11/2001 Koike et al.
6,329,444 B1 12/2001 McGlothlin et al.
6,345,903 B1 2/2002 Koike et al.
6,350,041 B1 2/2002 Tarsa et al.
6,351,069 B1 2/2002 Lowery et al.
6,356,691 B2 3/2002 Seong-jin et al.
6,408,123 B1 6/2002 Kuroda et al.
6,417,616 B2 7/2002 Lee
6,473,554 B1 10/2002 Pelka et al.
6,488,704 B1 12/2002 Connelly et al.
6,491,443 B1 12/2002 Serizawa et al.
6,501,100 B1 12/2002 Srivastava et al.
6,501,102 B2 12/2002 Mueller-Mach et al.
6,504,301 B1 1/2003 Lowery
6,522,065 B1 2/2003 Srivastava et al.
6,527,419 B1 3/2003 Galli
6,528,755 B2 3/2003 Grewell et al.
6,530,670 B2 3/2003 Hirayama et al.
6,549,709 B1 4/2003 De Dobbelaere et al.
6,551,346 B2 4/2003 Crossley
6,554,462 B2 4/2003 Hulse et al.
6,599,000 B2 7/2003 Nolan et al.
6,608,332 B2 8/2003 Shimizu et al.
6,614,179 B1 9/2003 Shimizu et al.
6,621,211 B1 9/2003 Srivastava et al.
6,635,363 B1 10/2003 Duclos et al.
6,635,987 B1 10/2003 Wojnarowski et al.
6,637,924 B2 10/2003 Pelka et al.
6,671,235 B1 12/2003 Hawryluk et al.
6,680,004 B2 1/2004 Ono et al.
6,687,010 B1 2/2004 Horii et al.
6,694,069 B2 2/2004 Kaneko et al.
6,709,132 B2 3/2004 Ishibashi
6,714,711 B1 3/2004 Lieberman et al.
6,754,408 B2 6/2004 Toda et al.
6,765,237 B1 7/2004 Doxsee et al.
6,796,698 B2 9/2004 Sommers et al.
6,817,735 B2 11/2004 Shimizu et al.
6,847,170 B2 1/2005 Kayser
6,850,665 B2 2/2005 Grubsky et al.
6,853,131 B2 2/2005 Srivastava et al.
6,871,982 B2 3/2005 Holman et al.
6,890,234 B2 5/2005 Bortscheller et al.
6,908,205 B2 6/2005 Greiner et al.
6,917,057 B2 7/2005 Stokes et al.
6,939,481 B2 9/2005 Srivastava et al.
6,941,069 B2 9/2005 Kaneko et al.
6,943,380 B2 9/2005 Ota et al.
6,948,829 B2 9/2005 Verdes et al.
6,965,709 B1 11/2005 Weiss
6,982,522 B2 1/2006 Omoto et al.
7,005,086 B2 2/2006 Matsuno et al.
7,006,306 B2 2/2006 Falicoff et al.
7,008,078 B2 3/2006 Shimizu et al.
7,015,510 B2 3/2006 Srivastava et al.
7,026,756 B2 4/2006 Shimizu et al.
7,038,246 B2 5/2006 Uemura
7,045,826 B2 5/2006 Kim et al.
7,052,152 B2 5/2006 Harbers et al.
7,066,623 B2 6/2006 Lee et al.
7,071,616 B2 7/2006 Shimizu et al.
7,086,767 B2 8/2006 Sidwell et al.
7,123,796 B2 10/2006 Steckl et al.
7,144,131 B2 12/2006 Rains
7,153,008 B2 12/2006 Grote, III et al.
7,178,941 B2 2/2007 Roberge et al.
7,193,248 B2 3/2007 Weindorf et al.
7,204,607 B2 4/2007 Yano et al.
7,215,086 B2 5/2007 Maxik
7,218,824 B2 5/2007 Franklin et al.
7,221,110 B2 5/2007 Sears et al.
7,230,222 B2 6/2007 Cheng et al.
7,251,389 B2 7/2007 Lu et al.
7,259,403 B2 8/2007 Shimizu et al.
7,267,787 B2 9/2007 Dong et al.
7,279,832 B2 10/2007 Thurk et al.
7,288,797 B2 10/2007 Deguchi et al.
7,293,906 B2 11/2007 Mok et al.
7,331,700 B2 2/2008 Zhang
7,345,317 B2 3/2008 Reeh et al.
7,347,586 B2 3/2008 Izardel
7,350,936 B2 4/2008 Ducharme et al.
7,367,692 B2 5/2008 Maxik
7,375,381 B2 5/2008 Shimizu et al.
7,382,091 B2 6/2008 Chen et al.
7,391,060 B2 6/2008 Oshio
7,396,142 B2 7/2008 Laizure, Jr. et al.
7,399,108 B2 7/2008 Ayabe et al.
7,425,798 B2 9/2008 St.-Germain
7,430,355 B2 9/2008 Heikenfeld et al.
7,433,565 B2 10/2008 Joseph et al.
7,479,733 B2 1/2009 Chang et al.
7,481,562 B2 1/2009 Chua et al.
7,482,565 B2 1/2009 Morgan et al.
7,513,669 B2 4/2009 Chua et al.
7,540,628 B2 6/2009 Awai et al.
7,597,470 B2 10/2009 Kurihara et al.
7,607,798 B2 * 10/2009 Panotopoulos ..... 362/233
7,607,815 B2 10/2009 Pang
7,635,203 B2 12/2009 Weaver, Jr. et al.
7,638,754 B2 12/2009 Morimoto et al.
7,639,916 B2 12/2009 Fine
7,661,841 B2 2/2010 Kurihara et al.
7,717,589 B2 5/2010 Nishioka et al.
7,719,022 B2 5/2010 Maeda et al.
7,722,211 B2 5/2010 Marra et al.
7,736,042 B2 6/2010 Park, II et al.
7,736,044 B2 6/2010 Chew et al.
7,738,054 B2 6/2010 Okumura et al.
7,791,683 B2 9/2010 Larson et al.
7,826,698 B1 11/2010 Meir et al.
7,845,839 B2 12/2010 Collier
7,891,852 B2 2/2011 Pugh et al.
7,903,198 B2 3/2011 Abe et al.
2001/0046142 A1 11/2001 Van Santen et al.
2001/0053072 A1 12/2001 Takemoto
2002/0118907 A1 8/2002 Sugama et al.
2002/0122629 A1 9/2002 Grubsky et al.
2003/0156425 A1 8/2003 Turnbull et al.
2003/0198455 A1 10/2003 Usami

(56) References Cited

U.S. PATENT DOCUMENTS

| | | | |
|---|---|---|---|
| 2004/0012556 | A1 | 1/2004 | Yong et al. |
| 2004/0156182 | A1 | 8/2004 | Hatjasalo et al. |
| 2004/0196648 | A1 | 10/2004 | Franklin et al. |
| 2004/0246697 | A1 | 12/2004 | Yamashita et al. |
| 2004/0257352 | A1 | 12/2004 | Naugler et al. |
| 2005/0041424 | A1 | 2/2005 | Ducharme |
| 2005/0100288 | A1 | 5/2005 | Chu |
| 2005/0116667 | A1 | 6/2005 | Mueller et al. |
| 2005/0243243 | A1 | 11/2005 | Koganezawa |
| 2005/0258432 | A1 | 11/2005 | Cho |
| 2005/0265403 | A1 | 12/2005 | Anderson et al. |
| 2006/0001036 | A1 | 1/2006 | Jacob et al. |
| 2006/0008205 | A1 | 1/2006 | Meir et al. |
| 2006/0092346 | A1 | 5/2006 | Moon et al. |
| 2006/0098434 | A1 | 5/2006 | Liu et al. |
| 2006/0131924 | A1 | 6/2006 | Reck |
| 2006/0193133 | A1 | 8/2006 | Von Der Brelie |
| 2006/0203502 | A1 | 9/2006 | Stevens et al. |
| 2006/0208670 | A1 | 9/2006 | Chang et al. |
| 2006/0221610 | A1 | 10/2006 | Chew et al. |
| 2006/0227085 | A1 | 10/2006 | Boldt et al. |
| 2006/0262250 | A1 | 11/2006 | Hobbs |
| 2006/0268537 | A1 | 11/2006 | Kurihara et al. |
| 2007/0019439 | A1 | 1/2007 | Yu et al. |
| 2007/0031097 | A1 | 2/2007 | Heikenfeld et al. |
| 2007/0053208 | A1 | 3/2007 | Justel et al. |
| 2007/0057626 | A1 | 3/2007 | Kurihara et al. |
| 2007/0086211 | A1 | 4/2007 | Beeson et al. |
| 2007/0133210 | A1 | 6/2007 | Watson et al. |
| 2007/0133935 | A1 | 6/2007 | Fine |
| 2007/0138966 | A1 | 6/2007 | Marka et al. |
| 2007/0187710 | A1 | 8/2007 | Steen et al. |
| 2007/0188425 | A1 | 8/2007 | Saccomanno |
| 2007/0247089 | A1* | 10/2007 | Summerland ..... 315/308 |
| 2007/0274094 | A1 | 11/2007 | Schultz et al. |
| 2007/0284600 | A1 | 12/2007 | Shchekin et al. |
| 2007/0297179 | A1 | 12/2007 | Leung et al. |
| 2008/0007541 | A1 | 1/2008 | Eliasson et al. |
| 2008/0029720 | A1 | 2/2008 | Li |
| 2008/0049445 | A1 | 2/2008 | Harbers et al. |
| 2008/0055931 | A1 | 3/2008 | Verstraete et al. |
| 2008/0061683 | A1 | 3/2008 | Bertram |
| 2008/0094348 | A1 | 4/2008 | Yin et al. |
| 2008/0122365 | A1 | 5/2008 | Decius et al. |
| 2008/0144333 | A1 | 6/2008 | Gourlay |
| 2008/0151576 | A1 | 6/2008 | Inditsky |
| 2008/0158907 | A1 | 7/2008 | Lin et al. |
| 2008/0186736 | A1 | 8/2008 | Rinko |
| 2008/0192458 | A1 | 8/2008 | Li |
| 2008/0205080 | A1 | 8/2008 | Erchak et al. |
| 2008/0212315 | A1 | 9/2008 | Cornelissen et al. |
| 2008/0218993 | A1 | 9/2008 | Li |
| 2008/0239749 | A1 | 10/2008 | Saccomanno et al. |
| 2008/0251690 | A1 | 10/2008 | Keiper et al. |
| 2008/0252571 | A1 | 10/2008 | Hente et al. |
| 2008/0297644 | A1 | 12/2008 | Farchtchian et al. |
| 2008/0305439 | A1 | 12/2008 | Khan |
| 2008/0316605 | A1 | 12/2008 | Hazell et al. |
| 2009/0001397 | A1 | 1/2009 | Fine et al. |
| 2009/0002668 | A1 | 1/2009 | Rohe et al. |
| 2009/0016060 | A1 | 1/2009 | Nakao |
| 2009/0027588 | A1 | 1/2009 | Medendorp, Jr. et al. |
| 2009/0046453 | A1 | 2/2009 | Kramer |
| 2009/0046978 | A1 | 2/2009 | Yasuda et al. |
| 2009/0051268 | A1 | 2/2009 | You et al. |
| 2009/0052205 | A1 | 2/2009 | Chen et al. |
| 2009/0059359 | A1 | 3/2009 | Nahm et al. |
| 2009/0059553 | A1 | 3/2009 | Lin |
| 2009/0067194 | A1 | 3/2009 | Sanchez |
| 2009/0116801 | A1 | 5/2009 | Fine |
| 2009/0129115 | A1 | 5/2009 | Fine et al. |
| 2009/0141476 | A1 | 6/2009 | Meir et al. |
| 2009/0151575 | A1 | 6/2009 | Eisendrath |
| 2009/0161340 | A1 | 6/2009 | Huang et al. |
| 2009/0161341 | A1 | 6/2009 | Meir et al. |
| 2009/0161361 | A1 | 6/2009 | Meir et al. |
| 2009/0161369 | A1 | 6/2009 | Regev et al. |
| 2009/0161383 | A1 | 6/2009 | Meir et al. |
| 2009/0162015 | A1 | 6/2009 | Meir et al. |
| 2009/0168395 | A1 | 7/2009 | Mrakovich et al. |
| 2009/0201955 | A1 | 8/2009 | Weigl et al. |
| 2009/0212718 | A1 | 8/2009 | Kawashima et al. |
| 2009/0225565 | A1 | 9/2009 | Zimmermann et al. |
| 2009/0225566 | A1 | 9/2009 | Zimmermann et al. |
| 2009/0236620 | A1 | 9/2009 | Park et al. |
| 2009/0250714 | A1 | 10/2009 | Yun et al. |
| 2009/0273918 | A1 | 11/2009 | Falicoff et al. |
| 2009/0284177 | A1 | 11/2009 | Pedersen |
| 2009/0290380 | A1 | 11/2009 | Meir et al. |
| 2009/0303412 | A1 | 12/2009 | Ake et al. |
| 2009/0310338 | A1 | 12/2009 | Negley |
| 2009/0315015 | A1 | 12/2009 | Shimizu et al. |
| 2009/0322251 | A1 | 12/2009 | Hilgers |
| 2010/0002414 | A1 | 1/2010 | Meir et al. |
| 2010/0008628 | A1 | 1/2010 | Shani |
| 2010/0014822 | A1 | 1/2010 | Fine |
| 2010/0033420 | A1 | 2/2010 | Jheng |
| 2010/0045189 | A1 | 2/2010 | Storch et al. |
| 2010/0046219 | A1 | 2/2010 | Pijlman et al. |
| 2010/0060157 | A1 | 3/2010 | Shi |
| 2010/0079841 | A1 | 4/2010 | Levola |
| 2010/0098377 | A1 | 4/2010 | Meir |
| 2010/0195306 | A1 | 8/2010 | Helbing et al. |
| 2010/0201611 | A1 | 8/2010 | Duong et al. |
| 2010/0208469 | A1 | 8/2010 | Shani |
| 2010/0208470 | A1 | 8/2010 | Shani et al. |
| 2010/0220484 | A1 | 9/2010 | Shani |
| 2010/0315817 | A1 | 12/2010 | Zimmermann |
| 2010/0320904 | A1 | 12/2010 | Meir |
| 2011/0013415 | A1 | 1/2011 | Meir et al. |

FOREIGN PATENT DOCUMENTS

| | | | |
|---|---|---|---|
| DE | 19952430 | | 5/2001 |
| EP | 0911658 | | 10/1998 |
| EP | 1376708 | | 1/2004 |
| EP | 1521503 | A1 | 4/2005 |
| EP | 1776722 | | 4/2007 |
| EP | 1876385 | A2 | 1/2008 |
| EP | 1901587 | A2 | 3/2008 |
| EP | 1988752 | A1 | 11/2008 |
| EP | 2018089 | A2 | 1/2009 |
| GB | 512062 | | 8/1939 |
| GB | 2339318 | | 1/2000 |
| GB | 2343361 | | 5/2000 |
| GB | 2448564 | | 10/2008 |
| JP | 5-127158 | | 5/1993 |
| JP | 10-247412 | | 9/1998 |
| JP | 04/241282 | | 8/2004 |
| JP | 05/085718 | | 3/2005 |
| KR | 09/0024279 | | 3/2009 |
| WO | WO-96/023649 | | 8/1996 |
| WO | WO-97/31219 | | 8/1997 |
| WO | WO-99/12400 | A1 | 3/1999 |
| WO | WO-01/82657 | A1 | 11/2001 |
| WO | WO-02/095289 | | 11/2002 |
| WO | WO-03/050448 | | 6/2003 |
| WO | WO-03/065201 | A1 | 8/2003 |
| WO | WO-2004/017109 | | 2/2004 |
| WO | WO-2004/034362 | A2 | 4/2004 |
| WO | WO-2004/053531 | | 6/2004 |
| WO | WO-2004/100275 | | 11/2004 |
| WO | WO-2005/096258 | A1 | 10/2005 |
| WO | WO-2005/101070 | | 10/2005 |
| WO | WO-2006/131924 | | 12/2006 |
| WO | WO-2007/044472 | | 4/2007 |
| WO | WO-2007/055509 | | 5/2007 |
| WO | WO-2007/071397 | A1 | 6/2007 |
| WO | WO-2007/086657 | | 8/2007 |
| WO | WO-2008/013097 | | 1/2008 |
| WO | WO-2008/035282 | A1 | 3/2008 |
| WO | WO-2008/045311 | | 4/2008 |
| WO | WO-2008/053063 | | 5/2008 |
| WO | WO-2008/059445 | A2 | 5/2008 |

(56) References Cited

FOREIGN PATENT DOCUMENTS

| | | |
|---|---|---|
| WO | WO-2008/093267 | 8/2008 |
| WO | WO-2008/146290 | 12/2008 |
| WO | WO-2008/148927 | 12/2008 |
| WO | WO-2009/130637 | 10/2009 |

OTHER PUBLICATIONS

Application Brief AB27 "For LCD Backlighting Luxeon DCC", Lumileds (2004).
Beeson et al., "61.5: LED-Based Light-Recycling Light Sources for Projection Displays," *SID Symp. Dig. of Tech. Papers*, 37(1): 1823-1826 (2006).
Fine, "Back Light Modular Unit (BLMu) for large LCD screens", SIL (2006).
International Search Report and Written Opinion for PCT/IL 08/01553, mailed Mar. 25, 2009 (11 pages).
International Search Report and Written Opinion for PCT/IL2006/000667, mailed Jun. 10, 2008 (7 pages).
International Search Report for PCT/IL2003/01042, mailed Jul. 29, 2004 (1 page).
International Search Report for PCT/IL2008/000730, mailed Nov. 25, 2008 (9 pages).
Jones-Bey, "High-Output LEDs: Solid-state lighting seeks a role in pictures," www.laserfocusworld.com/articles (May 21, 2009).
Smith-Gillespie, R., "LCD Backlighting Options and Design Considerations", SID Display Applications Tutorial (May 22, 2008).
Zwanenburg et al., "41.2: High efficiency LEDs for LCD Backlights," *SID 04 Digest*, p. 1222, ISSN/0004-0966X/04/3502-1222 (2004).
International Search Report and Written Opinion for PCT/IL2008/01554, mailed May 19, 2009 (10 pages).
"Solid-State Lighting Research and Development: Multi-year Program Plan," U.S. Department of Energy, 162 pages (Mar. 2010).
International Search Report and Written Opinion for PCT/IL2009/000248, mailed Dec. 14, 2009 (25 pages).
Office Action in Israel Patent Application No. 169122, mailed Dec. 22, 2008 (translation—5 pages).
Tsao et al., "Solid-state lighting: an integrated human factors, technology and economic perspective," Proc. IEEE, pp. 1-18 (Aug. 2009).
International Search Report and Written Opinion for PCT/1B2010/052844, mailed Mar. 31, 2011 (11 pages).

* cited by examiner

INDEPENDENTLY CONTROLLABLE ILLUMINATION DEVICE

CROSS-REFERENCE TO RELATED APPLICATION

This application claims priority to and the benefit of U.S. Provisional Patent Application No. 61/163,988, filed on Mar. 27, 2009, the entire disclosure of which is incorporated by reference herein.

FIELD OF THE INVENTION

In various embodiments, the present invention generally relates to illumination devices, and in particular to illumination devices incorporating independent sensing and control functionality.

BACKGROUND

Illumination systems relying on light-emitting diodes (LEDs) as light sources should maintain a consistent light-illumination (i.e., intensity) level and output color coordinates (e.g., a specific set or range of x-y coordinates on the CIE Chromaticity Diagram) throughout their lifespan, even while operating in changing environmental conditions. Such consistency should not require external intervention by a user, as such intervention is generally impractical. The consistency in light output is even more important for systems assembled from many discrete illumination elements in a tiled or overlapping fashion, such as backlight units for liquid-crystal displays, as such systems should have the same illumination properties regardless of location.

In order to help assure consistent light output from illumination units or systems including multiple LEDs, manufacturers often rely upon the "binning" of LEDs into groups having substantially similar emission properties. Binning helps to reduce the amount of device-to-device variation, since it partially compensates for manufacturing differences among LEDs. However, binning is imperfect, time-consuming, and expensive, particularly when LEDs must be binned according to both intensity and emission wavelength (i.e., color).

In order to supply illumination systems and devices with consistent light-emission properties, there is a need for illumination units that are independently controllable, i.e., that incorporate sensors that detect illumination characteristics, as well as circuitry to control each LED's operation based at least in part on the sensed characteristics. Such units should account for not only short-term changes in illumination behavior (e.g., due to local temperature variation), but also longer-term changes due to, e.g., aging of the LEDs. Furthermore, since it may be desirable for each individual illumination unit to incorporate one or more sensors, such sensor(s) should interfere with light propagation from the LEDs as little as possible.

SUMMARY

In accordance with certain embodiments, illumination systems having system-level control of individually controllable illumination units are provided. Embodiments of the invention separate, conceptually or in terms of discrete hardware and/or software components, local control of each illumination unit from general control of the overall system. The connection between the two levels of control—local and system—may occur via a direct-command and/or communication-command interface. The components that support local control may be assembled in the illumination unit as an integral part thereof. Alternatively, some or all of the components may be assembled outside the illumination unit but still connected thereto. In some embodiments, some of the control components control a number of illumination units jointly or by time-division multiplexing.

The control of individual units may be based in part on stored calibration data related to short-term changes in LED behavior due to, e.g., temperature variation. The calibration data may be utilized to control the output characteristics of the LED over short time periods and may also be updated and/or extrapolated to account for long-term changes in LED behavior due to, e.g., aging. Moreover, in illumination units based incorporating multiple LEDs (e.g., red, green, and blue, collectively "RGB") that combine to form a particular color gamut, the individual control system may compensate for variations in the output of one or more of the LEDs by varying the output of the other LED(s). The flexibility afforded by this individual control enables the illumination units to be utilized in any type of illumination system, regardless of application, as long as the system's prescribed illumination intensity and color coordinates are within the working range of the illumination unit. For example, an illumination unit incorporating RGB LEDs (with or without at least one optional amber LED) may output tunable white light, i.e., white light having color coordinates selectable from a wide range thereof (e.g., "cool" white light featuring more blue light, or "warm" white light featuring more red light).

Individual unit control may also be based at least in part on data from sensors that may be located near each LED, preferably in locations that do not interfere with efficient propagation of the light emitted by the LED. Placing sensors on or near the illumination units enables the collection of various data concerning each illumination unit, e.g., the illumination intensity of each color or even of each LED assembled in the illumination unit; the wavelength of each color or emitted by each LED; and/or the junction temperature of each LED. These values may be obtained by analysis of the measured values and any relevant calibration data for the sensors and the LEDs themselves.

Calibration data may be stored in a memory, and may include information regarding the behavior of the specific LEDs of an illumination unit. This behavior data facilitates determination of the proper adjustments to maintain consistent illumination intensity and/or color coordinates. The data may reflect the response of a specific LED to electrical current, variation in the wavelength emitted by the LED as a function of temperature, etc.

Local control allows flexibility in controlling the illumination intensity and/or the color coordinates by regulating the operating current of the LED and/or by adjusting pulse duration and frequency in a pulse-width modulation (PWM) method of operation. The local control may be independent from central control of one or more illumination units at the system level. The local control may substantially eliminate the need to bin LEDs, i.e., illumination units in accordance with the invention may feature substantially unbinned LEDs. For example, different illumination units in an illumination system may utilized substantially unbinned LEDs yet still emit substantially identical color coordinates and intensities, enabled by local control (e.g., different driving conditions) of the LEDs therein. As used herein, "substantially unbinned" may refer to LEDs that emit nominally similar colors, e.g., "red" or "blue," but for a given drive current or junction temperature emit wavelengths different by more than approximately ±5 nm, or even by more than approximately ±10 nm (i.e., from each other or from a nominal wavelength). Since even substantially unbinned LEDs may be at least "grouped" nominally by wavelength, the wavelengths emitted by substantially unbinned LEDs may still be different by less than approximately ±20 nm (i.e., from each other or from a nominal wavelength). Illumination units containing substantially unbinned LEDs may still emit light having substantially similar color coordinates, i.e., different by less than approximately ±0.01 in x and/or y CIE color coordinates (i.e., from each other or from a nominal color coordinate).

In an aspect, embodiments of the invention feature an illumination system including or consisting essentially of a plurality of LED units, a system controller, at least one sensing unit, and a plurality of local controllers each associated with at least one LED unit. Each local controller may be associated with a different LED unit. Each LED unit includes a plurality of differently colored, independently controllable LEDs forming a color gamut. The system controller generates control signals for each of the LED units consistent with a desired system-level output. The sensing unit(s) senses the operating state of the LEDs during their operation. Each local controller includes or consists essentially of a memory and a compensator. The memory includes or consists essentially of calibration data for use over a short time period. The compensator updates the calibration data based on measurements from a sensing unit over a long time period longer than the short time period. Based at least in part on the calibration data, the local controller operates the LEDs of the LED unit to maintain output intensities consistent with commands issued by the system controller.

Each of the LED units may have a separate sensing unit, which may sense temperature, intensity, and/or color. The calibration data may include or consist essentially of in-cycle calibration data, long-term calibration data, and/or sensor calibration data. The in-cycle calibration data is used by the local controller over a single cycle between activation and de-activation of the LED unit, and the long-term calibration data is used by the local controller to adjust a baseline current level to each of the LEDs. During the cycle, the local controller may use pulse-width modulation to adjust the outputs of the LEDs based on the in-cycle calibration data. During the cycle, the local controller may adjust the outputs of the LEDs based on the in-cycle calibration data and the temperature of each LED measured by the sensing unit. The compensator may determine a cycle-to-cycle trend based on prior cycles, extrapolate the trend to the current cycle, and/or update the long-term calibration data prior to the current cycle. The compensator may determine a cycle-to-cycle trend based on prior cycles and the current cycle, extrapolate the trend to a subsequent cycle, and/or update the long-term calibration data following the current cycle. An LED unit may output tunable white light and/or include or consist essentially of at least one red LED, at least one green LED, at least one blue LED, and at least one amber LED. At least two LED units may include substantially unbinned LEDs (e.g., that roughly emit the same color) and emit substantially identical output light (i.e., light having substantially equal intensity and/or color). One or more of the local controllers may include a PWM decoder for decoding signals received from the system controller.

In another aspect, embodiments of the invention feature a method of illumination. An LED unit that includes or consists essentially of a plurality of differently colored, individually controllable LEDs forming a color gamut is provided. In-cycle calibration data is utilized over a single cycle between activation and de-activation of the LED unit to maintain a consistent output intensity. The baseline current level to each of the LEDs is adjusted based on long-term calibration data to maintain the consistent output intensity.

During the cycle, pulse-width modulation may be used to adjust the outputs of the LEDs based on the in-cycle calibration data. During the cycle, the outputs of the LEDs may be adjusted based on the in-cycle calibration data and the temperature of each LED. A cycle-to-cycle trend based on prior cycles may be extrapolated to the current cycle, and the long-term calibration data may be updated prior to the current cycle. A cycle-to-cycle trend may be determined based on prior cycles and the current cycle, and the trend may be extrapolated to a subsequent cycle. The long-term calibration data may be updated following the current cycle.

At least one additional LED unit including or consisting essentially of a plurality of differently colored, individually controllable LEDs forming a color gamut may be provided. Control signals for the LED unit and the additional LED unit consistent with a desired system-level output may be generated. The LED unit and the additional LED unit may include substantially unbinned LEDs and/or may emit substantially identical output light (i.e., light having substantially equal intensity and/or color). the control signals, which may include PWM signals, may be decoded.

In yet another aspect, embodiments of the invention feature an illumination unit including or consisting essentially of at least one LED, a discrete in-coupling region for receiving light from the LED(s), and a discrete out-coupling region for emitting light. The unit may include at least one sensor for sensing photometric data from the LED(s) during their operation. The sensor(s) may be outside the direct line-of-sight between the LED(s) and the out-coupling region.

The sensor(s) may be located substantially perpendicular to the direct line-of-sight between an LED and the out-coupling region. At least one LED may be located between at least one sensor and the out-coupling region. The LED(s) may be multiple LEDs arranged in a substantially linear row. At least one sensor may be located at one end of the row or near a center point of the row (e.g., offset from the row near the center point). The LEDs may include or consist essentially of at least one red LED, at least one green LED, at least one blue LED, and/or at least one amber LED. The LEDs may be symmetrically arranged about the center point by color. The sensor(s) may include or consist essentially of a temperature sensor, a color sensor, and/or an intensity sensor. The LEDs may be arranged in a substantially linear row, and the temperature sensor and the intensity sensor may be located at opposing ends of the row. The LED(s) may be located within the in-coupling region and on a sub-assembly, and the sensor(s) may be located on the sub-assembly.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein, the term "substantially" means ±10%, and in some embodiments, ±5%.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
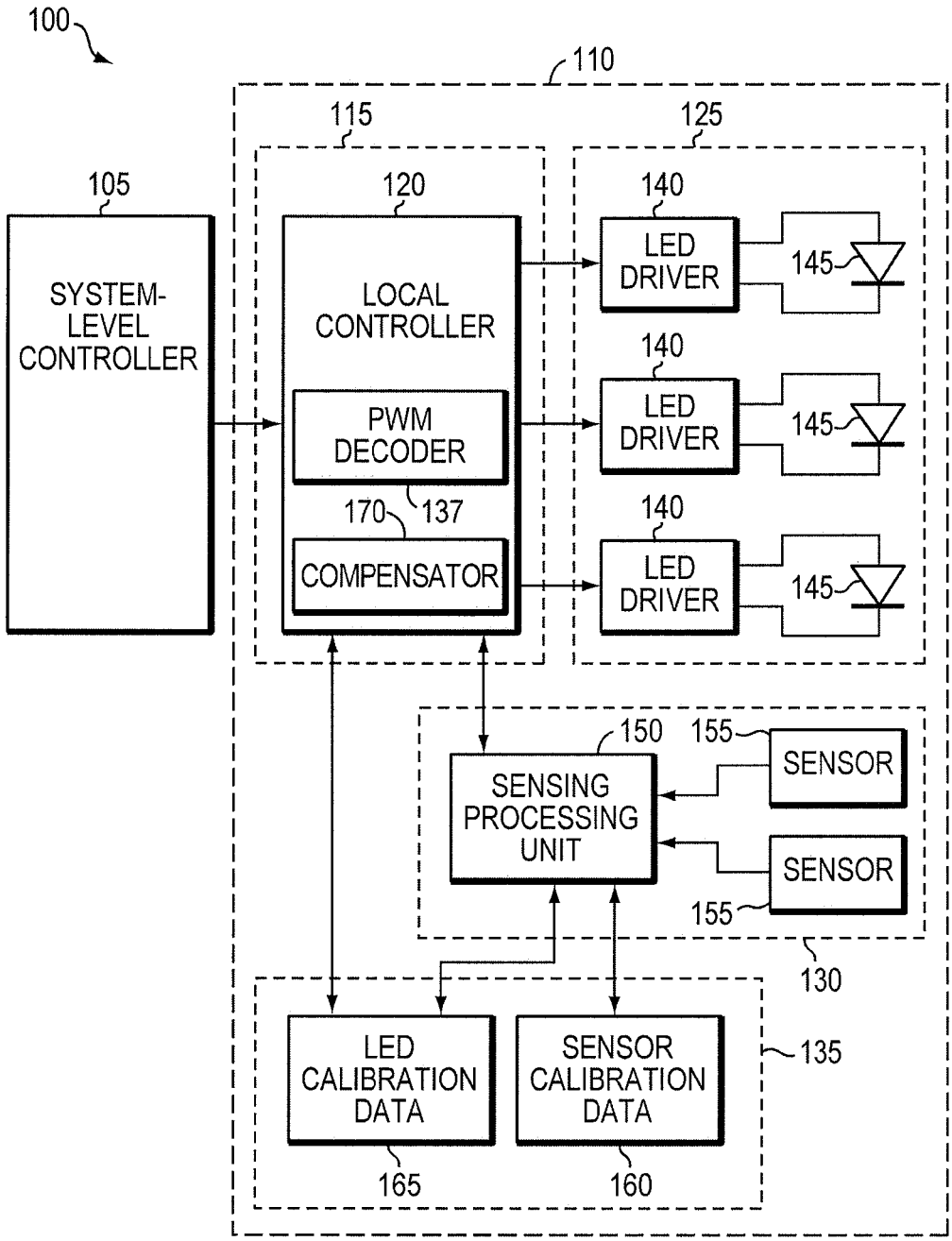
FIG. 1 is a schematic block diagram of an exemplary illumination system in accordance with various embodiments of the invention.

Referring to FIG. 1, an illumination system 100 includes a system-level controller 105 and one or more illumination units 110. As depicted, illumination unit 110 contains a control unit 115, which includes a local controller 120. Illumination unit 110 also contains an LED operating unit 125, a sensing unit 130, and a memory unit 135. Control unit 115, LED operating unit 125, sensing unit 130, and memory unit 135 are functional units, and may or may not correspond to discrete parts of or circuits in illumination unit 110. Moreover, at least some of the functions of these units may be implemented in software and/or as mixed hardware-software modules. Software programs implementing the functionality herein described may be written in any of a number of high level languages such as FORTRAN, PASCAL, JAVA, C, C++, C#, BASIC, various scripting languages, and/or HTML. Additionally, the software can be implemented in an assembly language directed to a microprocessor resident in control unit 115. The software may be embodied on an article of manufacture including, but not limited to, a floppy disk, a jump drive, a hard disk, an optical disk, a magnetic tape, a PROM, an EPROM, EEPROM, field-programmable gate array, or CD-ROM. Embodiments using hardware-software modules may be implemented using, for example, one or more FPGA, CPLD, or ASIC processors.

As described further below, portions of any or all of these functional units may be grouped differently in physical manifestations of illumination unit 110 and illumination system 100. Although illumination unit 110 is depicted as containing a dedicated sensing unit 130 and memory 135, in various embodiments multiple illumination units 110 may share a single large sensing unit 130 and/or memory unit 135. Similarly, the various above-described components of illumination unit 110 may be physically located on the illumination unit 110 or with system-level controller 105, so long as each illumination unit 110 is individually controlled by separate, dedicated circuitry. Further, all or portions of sensing unit 130 and/or memory unit 135 may be integrated within control unit 115 and/or local controller 120.

System-level controller 105 generates control signals for each illumination unit 110 consistent with a desired system-level output, e.g., a desired illumination level (i.e., intensity) and/or color gamut to be emitted by illumination system 100. The control signals from system-level controller 105, which may be PWM signals, are communicated to each local controller 120 in control unit 115. PWM commands may be executable in the form received from the system-level controller 105 or may require decoding. Thus, the control unit 115 may include an onboard PWM decoder 137. The decoder 137 decodes the command and enables the local controller 120 to tune the PWM signal and to issue the appropriate PWM signal to LED drivers 140. In some embodiments, the PWM pulse train is utilized directly as a time-varying driver voltage rather than an information-containing signal to be decoded. In such implementations, no PWM decoder 137 is necessary. PWM decoder 137 may be straightforwardly implemented as instructions executable by local controller 120 and implementing the functions described herein, or may be a dedicated hardware module in control unit 115 or local controller 120.

In turn, the local controller 120, which also receives data from sensing unit 130 regarding the operating state (i.e., the junction temperature, emission intensity, and/or emission wavelength) of the LED(s) controlled by LED operating unit 125, operates a control process that modulates the driving current supplied to the LED(s) and/or the duration (i.e., the duty cycle) of the pulse according to which the LED(s) are operated. In addition, local controller 120 may adjust the pulse frequency. The control process operates in a controlled, feedback fashion based on the continuous flow of data from the sensing unit 130 in order to have the operation values received within the working range dictated by system-level controller 105.

LED operating unit 125 contains one or more LED drivers 140, each of which controls one or more LEDs 145 by, e.g., switchably driving a constant current therethrough. References herein to an LED, e.g., an LED emitting a specific color, should be understood to refer to one or more LEDs that emit the same color and are interconnected to produce a single overall output. As described above, the output of the illumination unit 110 may be regulated by varying the current passing through the LED(s) 145 and/or by altering the duration of operation of the LED(s) 145. Similarly, the color coordinates of illumination unit 110 may be established by adjusting the output illumination levels of differently colored LEDs 145 so that the color-mixed output corresponds to the desired color coordinates. This may be implemented by changing the current level through each of the differently colored LEDs 145 or the illumination times of the LEDs 145 (e.g., using PWM). The current value at each LED 145 may be determined by a reference voltage at the input terminal of the LED's driver 140. The reference voltage, in turn, is established and supplied by the local controller 120. The local controller 120 may set the illumination output of each LED 145 using PWM rather than a specific current level. A single driver 140 may control a single LED 145 or multiple LEDs 145 that are serially connected. Either way, the current level through the LED(s) 145 will generally be constant, and the voltage may change according to the operating voltage of each LED 145 and/or the number of LEDs 145 connected in serial fashion. Each driver 140 may receive power from an external power source (not shown).

In a preferred embodiment, LEDs 145 include or consist essentially of at least one each of red-, green-, and blue-emitting LEDs, and illumination unit 110 emits substantially white light derived from the mixture of the red, green, and blue light. LEDs 145 may also include amber-emitting LEDs. The white light emitted by illumination unit 110 may be tunable, as detailed above.

Sensing unit 130 includes a sensing processing unit 150 (which may be, e.g., a microcontroller, microprocessor, or other dedicated circuitry) and one or more sensors 155. The sensors 155 detect and provide data to the sensing processing unit 150 regarding the operating state of the LED(s) 145. This data is used to maintain proper operation and output characteristics (which typically include the illumination intensity and color coordinates) of illumination unit 110. The output characteristics, in turn, are determined by the illumination intensity and wavelength of the light emitted by each LED 145.

In order to enable the local controller 120 to maintain consistent output characteristics over time and/or in changing environmental conditions, sensing unit 130 may utilize one or more photometric sensors 155 that measure the illumination intensity and output wavelength of the light emitted by each LED 145. Light detected by the photometric sensor 155 is typically converted into a voltage that is sampled and digitized by the sensing processing unit 150. This data is provided to the local controller 120, which adjusts operation of the relevant LED 145 accordingly. In an embodiment, a multi-photometric sensor 155 is utilized for each illumination color emitted by an LED 145 in illumination unit 110. The multi-photometric sensor 155 may be an integrated device containing multiple sensors, each sensitive to different wavelengths of light, or may be a single sensor with multiple "zones" or regions, each sensitive to a different wavelength of light. A multi-photometric sensor 155 may directly and substantially simultaneously sense light intensity and color (e.g., CIE color coordinates). Alternatively, a single sensor 155 that measures illumination intensity may be utilized (e.g., for each LED 145). Either type of intensity sensor 155 may be utilized in tandem with a temperature sensor 155. The illumination sensor 155 is operated synchronously with the operation of the LEDs 145 such that, during specific time slices, only a single color of light is emitted and detected by the sensor 155. The time slices during which only one color is emitted may be long enough for the sensor 155 to measure the intensity and/or wavelength of the light but short enough such that the absence of the other colors from the color gamut is indistinguishable to an observer, e.g., on the order of tens of microseconds. Integrating the resulting intensity data with the temperature data enables computation of the wavelength emitted from the LED 145, as the wavelength parameter depends directly on the temperature of the LED and the current passing though it (which is a known quantity derived from the constant-current driving method). The temperature data also allows the local controller 120 to control the output of each LED 145 according to its temperature (as further described below).

The wavelength of each LED 145 may also shift over time as a consequence of continued operation (i.e., aging). Compensation for wavelength shifts generally will also account for expected variations over time, which may be correlated with intensity degradation. As a result, it is generally possible to estimate the wavelength shift based on observed intensity in view of a calibration curve that relates intensity changes to wavelength changes due to aging effects. Such calibration data is typically stored in memory unit 135, and may even be updated on a dynamic basis as described below.

The memory unit 135 stores data required for proper operation of the sensing unit 130 and the local controller 120. In addition, the memory unit 135 may contain specific information regarding the individual illumination unit 110 such as the serial number, operation time, fault history, etc. Memory unit 135 may store sensor calibration data 160 relating the output of sensors 155 to the input(s) they receive, preferably on an individual sensor-by-sensor basis, or at least for each type of sensor 155 utilized. Sensor calibration data 160 may be utilized by sensing processing unit 150 and/or local controller 120 to relate the output of sensor(s) 155 to the input(s) they receive, thus facilitating local control of LEDs 145 in illumination unit 110.

Memory unit 135 typically also stores LED calibration data 165 relating to the characteristics of the specific LEDs 145 during operation as a function of, e.g., LED junction temperature and/or current level. For example, LED calibration data 165 may include or consist essentially of the responses of a particular LED (e.g., its emission intensity and/or wavelength) as functions of forward voltage, drive current, and/or junction temperature. The LED calibration data 165 may include measured data and/or extrapolations and interpolations based on such data. Such data may be substantially unique for each LED 145 in illumination unit 110. Based on sensor calibration data 160 and LED calibration data 165, local controller 120 adjusts the operation of LEDs 145 by, e.g., PWM and/or adjustment of operating current level, based on the inputs to sensors 155. In this manner, illumination unit 110 and illumination system 100 may include LED(s) 145 that have not been binned by, e.g., the manufacturer of LEDs 145, illumination unit 110, and/or illumination system 100. Sensor calibration data 160 and/or LED calibration data 165 may include or consist essentially of a look-up table and/or fits to experimental data, e.g., polynomial fits.

LED calibration data 165 may be utilized by local controller 120 over short time periods without being updated or corrected based on the output intensity, output color, and/or junction temperature of an individual LED 145 detected by a sensor 155. As used herein, a "short" time period may correspond to a period on the order of (or corresponding exactly to) a cycle of use, i.e., the time between activation and de-activation of illumination unit 110 and/or illumination system 100. The memory unit 135 and/or the local controller 120 may also include a compensator 170 that updates the LED calibration data 165 based on measurements from sensing unit 130 over a long time period (i.e., a time period longer than a short time period). As used herein, a "long" time period may correspond to a time period, on average, at least twice as long as a short time period. In particular embodiments, a long time period means a timeframe spanning multiple cycles of use of illumination unit 110 and/or illumination system 100, even if measurements are actually taken only during the times that illumination unit 110 and LED(s) 145 are active. Compensator 170 may also update sensor calibration data 160 in a similar fashion. Compensator 170 may be straightforwardly implemented as instructions executable by local controller 120 and implementing the functions described herein.

In an embodiment, LED calibration data 165 includes both in-cycle calibration data (i.e., data utilized within a cycle of use) and long-term calibration data (i.e., data utilized across multiple cycles of use). The in-cycle calibration data typically relates the output characteristics (e.g., color coordinates and/or intensity) of an LED 145 to factors influencing the output characteristics over the short term. These factors include, e.g., changes in ambient and/or system temperature or other environmental conditions, as both emission wavelength and intensity may be impacted by the temperature (in particular the junction temperature) of LED 145. The local controller 120 may utilize the in-cycle calibration data during a single cycle between activation and de-activation of illumination unit 110 and/or illumination system 100 by, e.g., manipulating the PWM duty cycle of an LED 145. For example, as the temperature of LED 145 increases, the PWM duty cycle of LED 145 may be increased by an amount derived from LED calibration data 165. Local controller 120 may also base its adjustments of the operation of the specific LED 145 based on its junction temperature measured by a sensor 155. The junction temperature may be estimated from temperature measurements taken at a location near the LED 145 or may be calculated based on the voltage applied to the LED, the current through the LED, and the output intensity of the LED via, e.g., the ideal diode equation.

The performance of an LED 145 (i.e., the amount of energy supplied to the LED 145 emitted as light) may be estimated from its junction temperature, as the energy emitted by an LED 145 not emitted as light is generally emitted as heat. This heat emission may raise the junction temperature of LED 145 by an amount dependent on the thermal conductivity of the path between LED 145 and the environment. If the transfer of heat from LED 145 is assumed to be primarily from conduction along a path with a substantially constant conductivity (e.g., to a heat sink having a measurable temperature), the amount of heat (i.e., the thermal power) emitted by LED 145 may be approximated by taking the difference between the junction temperature and the heat sink, and then dividing that difference by the thermal resistance of the path between the LED 145 and the heat sink. Then, the electrical power supplied to the LED 145 may be estimated by multiplying the driving current and the forward voltage therethrough. Thus, the amount of energy supplied to the LED 145 emitted as light is the difference between the total electrical power supplied to the LED 145 less the amount of power emitted by the LED 145 as heat. This performance metric may be calculated regardless of the configuration of illumination unit 110, as long as the approximate thermal conductivity between the LED 145 and the other point of measurement is known. The performance of each LED 145 thus measured and calculated facilitates measurement of changes in the output of LED 145 as a function of changed environment, conditions, or aging. It also allows measurement of actual optical efficiency of illumination unit 110.

The long-term calibration data typically relates the output characteristics of an LED 145 to factors influencing the output characteristics over long periods of time, e.g., aging of the LED 145 due to extended use. The local controller 120 may utilize the long-term calibration data to compensate for these aging effects by, e.g., adjusting the baseline current level supplied to the LED 145. Either or both of the in-cycle and long-term calibration data may be dynamically updated by compensator 170 as described above, e.g., on a cycle-by-cycle basis. In an embodiment, after a "long" time period (e.g., following an activation and de-activation of illumination system 100 or between approximately 100 hours and approximately 200 hours of use), each LED 145 in each illumination unit 110 is evaluated at or during power-down of illumination system 100. The intensity and temperature of each LED 145 is measured by sensors 155 in order to evaluate aging effects.

Even in embodiments in which an LED 145 and a sensor 155 are located on a common heat sink or heat spreader (as further described below in relation to FIGS. 4A and 4B), the actual temperatures of LED 145 and sensor 155 may be different during the initial calibration process (i.e., to formulate sensor calibration data 160 and LED calibration data 165) and/or when intensity measurements are taken during operation. Thus, typically during the initial calibration, an initial intensity measurement and temperature measurement are performed for each LED 145 at a defined operating current. Later measurements made during operation of illumination unit 110 may be compared to this initial measurement after compensating for the effects of temperature on the output of sensor 155. In an embodiment, there is an approximately linear relationship between the temperature of a sensor 155 and its output photocurrent, the photocurrent decreasing substantially monotonically with increasing temperature (at a constant LED illumination flux). The slope of this relationship may also be stored and utilized as a calibration parameter for illumination unit 110.

The above-described separation between short-term and long-term sensing and control of the output of LED(s) 145 may be particularly beneficial when the LED(s) 145 are operated in pulsed mode. Since the heat capacity of an LED 145 is typically smaller than many other components of illumination unit 110, the thermal response time of an LED 145 may be fairly short, even on the order of milliseconds. Since in pulsed mode the LED 145 may be turned on and off at a frequency on this order, it may be beneficial to perform the above-described short-term control of its output on an approximately continuous basis, while the long-term control may be performed less frequently.

Memory unit 135 may also store output data from sensing unit 130 over long time periods, e.g., on a cycle-by-cycle basis. When updating LED calibration data 165, compensator 170 may determine a cycle-to-cycle trend based on data from past cycles and extrapolate the trend—linearly or nonlinearly, depending on the implementation to the current cycle, determining (at least in part) the individualized commands issued to an LED 145 by local controller 120. Compensator 170 may even update long-term calibration data between cycles, i.e., prior to the current cycle. In another embodiment, compensator 170 determines a cycle-to-cycle trend based on data from prior cycles and the current cycle and extrapolates the trend to a subsequent cycle (and/or updates long-term calibration data during or following the current cycle based on the trend).

Figure 2:
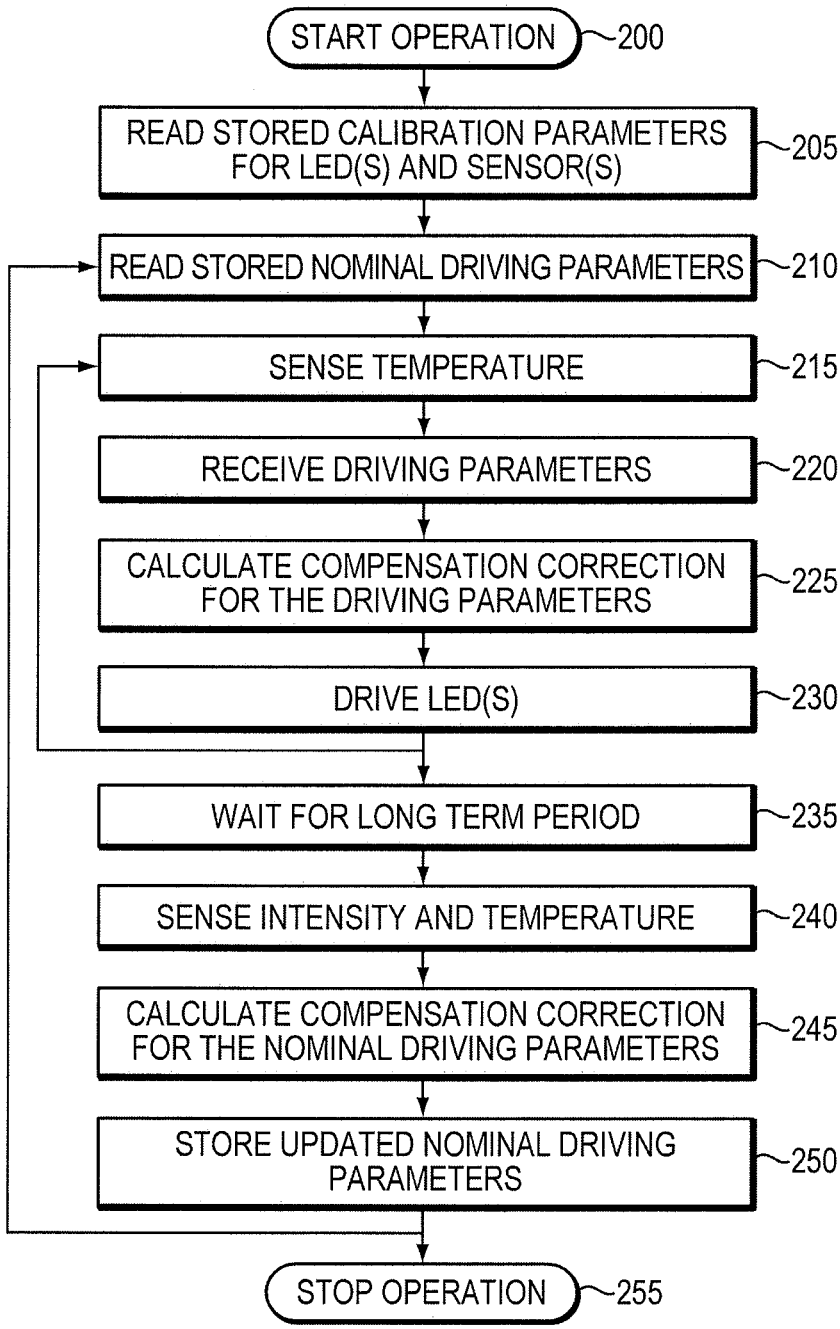
FIG. 2 is a flowchart of an exemplary method of controlling illumination in accordance with various embodiments of the invention.

FIG. 2 depicts an exemplary method of controlling the light output from illumination unit 110. In steps 200 and 205, the operation starts and the calibration parameters for one or more LEDs 145 and for one or more sensors 155 are read from the LED calibration data 165 and the sensor calibration data 160, respectively, in memory unit 135. Then, in step 210, the nominal driving parameters (e.g., the forward current, duty cycle, and/or pulse frequency of operation) for the LED(s) 145 are read from LED calibration data 165. In step 215, the temperature of or near the LED 145 (e.g., its junction temperature) is sensed by a sensor 155. The desired driving parameters for the LED 145 are received from the system-level controller 105 (e.g., based on a desired illumination condition for a desired application of illumination system 100 and/or illumination unit 110) in step 220. Based at least on the temperature measured in step 215 (as well as, e.g., the nominal driving parameters), compensator 170 calculates the compensation correction for the driving parameters in step 225. In step 230, the LED 145 is driven by its LED driver 140 with the compensated driving parameters, thus emitting the desired intensity and/or wavelength. These steps are preferably performed in parallel for each LED 145 in illumination unit 110. As shown, steps 215-230 are repeated on a short-term basis, e.g., multiple times per cycle, or at least until the measured temperature of LED 145 is substantially constant.

As indicated by step 235, over the long term, additional steps are also performed, as described above. In step 240, the intensity and temperature of one or more LEDs 145 is measured by one or more sensors 155. In step 245, compensator 170 calculates the compensation correction for the nominal driving parameters of the LED 145 based on the intensity (which may have decreased due to, e.g., aging of the LED 145) and the temperature sensed in step 240. The compensation correction is utilized to update a stored nominal driving parameter for the LED 145 that was read in step 210, e.g., its nominal driving current. In this manner, the long-term calibration data component of LED calibration data 165 is updated based on the long-term performance of the LED 145. As shown, steps 210-250 may then repeat on a long term basis, e.g., approximately every one or more cycles of illumination unit 110 being activated and de-activated, until the operation is stopped at step 255.

Figure 3:
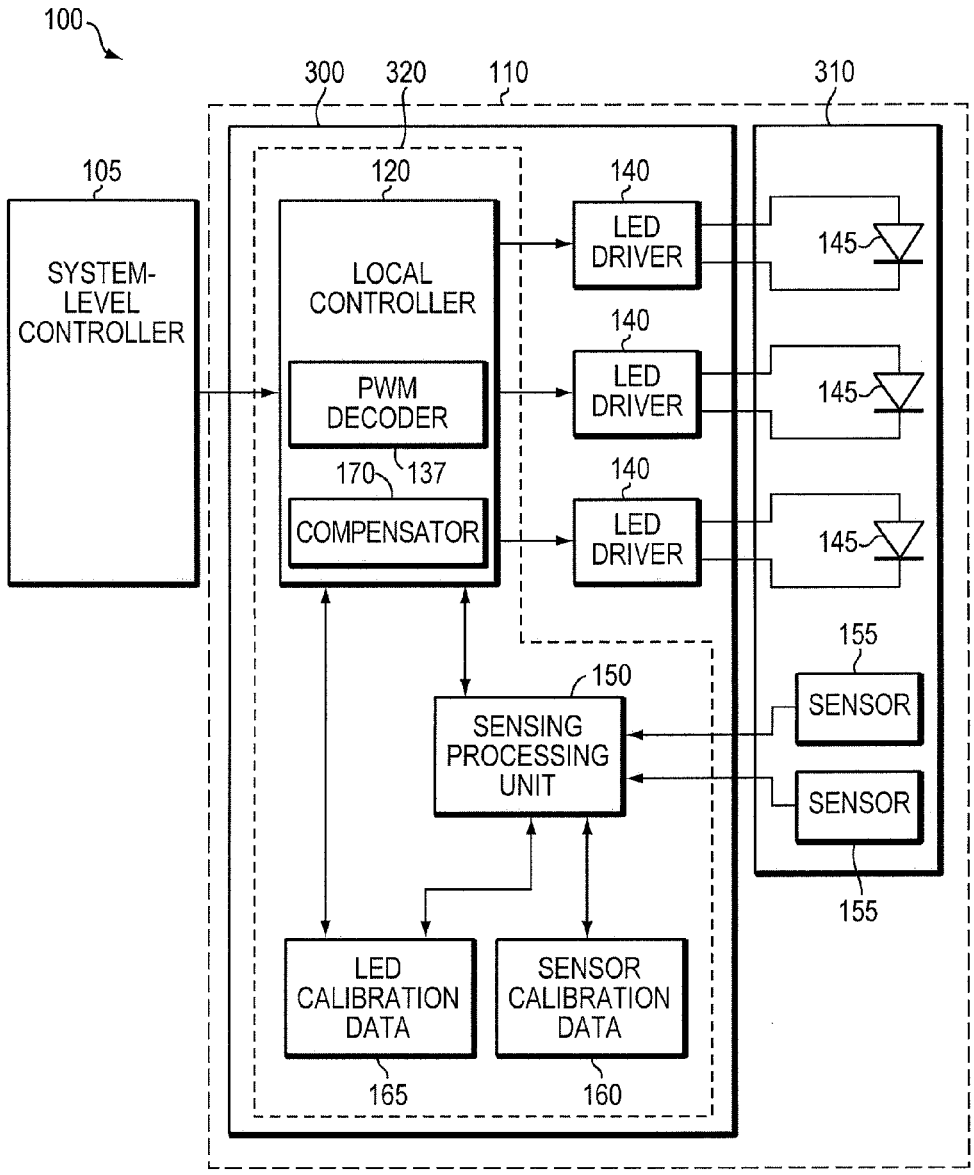
FIG. 3 is a schematic block diagram of an exemplary architecture of an illumination system in accordance with various embodiments of the invention.

FIG. 3 depicts an exemplary architecture of illumination system 100 that includes a printed circuit board (PCB) 300 electrically connected to a carrier 310. As illustrated, present upon PCB 300 are a processing unit 320 and the LED driver(s) 140. Processing unit 320 contains the functionality of local controller 120 (including compensator 170), sensing processing unit 150, and a memory including at least LED calibration data 165 and sensor calibration data 160. Processing unit 320 may be, e.g., one or more microprocessors, microcontrollers, or other dedicated circuitry. The carrier 310 serves as the physical platform for the LED(s) 145 and the sensor(s) 155. The physical arrangement depicted in FIG. 2 is exemplary, and many other physical configurations of the components of illumination unit 110 are possible, as long as the above-described functional units are operationally associated with and dedicated to a single illumination unit 110.

The control unit 115 may include a number of internal interfaces to the other components of illumination unit 110, as well as one or more external interfaces to system-level controller 105, as pictured in FIG. 1 and/or as described below. The internal interfaces may include:

An interface to memory unit 135 for receiving sensor calibration data 160 and LED calibration data 165.

An interface to the sensing unit 130 to receive the measurement data relating to operation of each sensor 155 and/or each LED 145. The data may be received as raw data or, following processing, as digital values that have been adjusted or filtered.

An interface facilitating communication between control unit 115 and the LED operating unit(s) 125, as well as control thereover. The control unit 115 provides the reference voltage to each driver 140, and may operate the driver 140 according to a PWM scheme. Moreover, the control unit 115 may transfer an enabling signal to driver(s) 140 to enable or disable operation of the illumination unit 110 altogether. Control unit 115 may also transfer a synchronization signal to the sensing unit 130 in order to coordinate its operation with time-division operation of the LEDs 145.

External interfaces may include:

A bi-directional communication channel that enables data transfer between the local control unit 115 and the system-level controller 105. Communication may occur according to any system-appropriate protocol, such as I2C or SPI. Data received from the system-level controller 105 may affect, for example, the pulse rate and the duty cycle for each color (e.g., emitted by a single LED 145) in illumination unit 110. The data transferred to the system-level controller 105 may also specify characteristics of particular illumination units 110 or their history of operation. This historical data may be saved in the memory unit 135 of the illumination unit 110.

An interface allowing control unit 115 to receive commands (e.g., PWM commands) from the system-level controller 105, which operates all illumination units 110 in illumination system 100. As mentioned above, PWM commands may be executable in the form received from the system-level controller 105 or may require decoding. Thus, the control unit 115 may include an onboard PWM decoder 137. The decoder 137 decodes the command and enables the local controller 120 to tune the PWM signal and to issue the appropriate PWM signal to LED drivers 140. The decoding process may cause some delay in the output signal. However, this delay is generally well-defined and stable, so the system-level controller 105 synchronizes system operation to account for this delay. In some embodiments, the PWM pulse train is utilized directly as a time-varying driver voltage rather than an information-containing signal to be decoded. In such implementations, no PWM decoder 137 is necessary.

An interface allowing the local control unit 115 to receive synchronization signals from the system-level controller 105.

An interface allowing the local control unit 115 to receive enabling signals from the system-level controller 105.

Figure 4A:
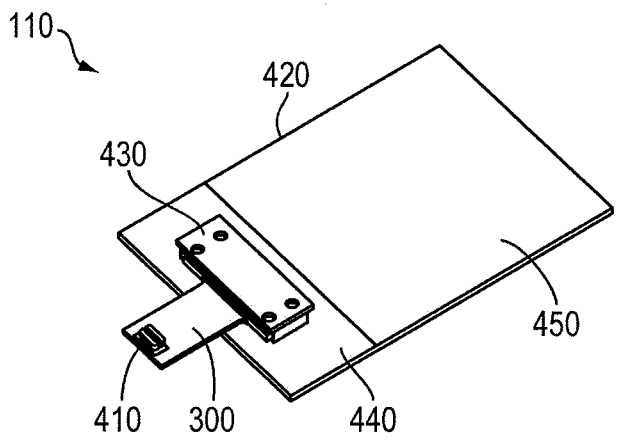
FIGS. 4A and 4B are perspective bottom and top views, respectively, of an illumination element in accordance with various embodiments of the invention.
Figure 4B:
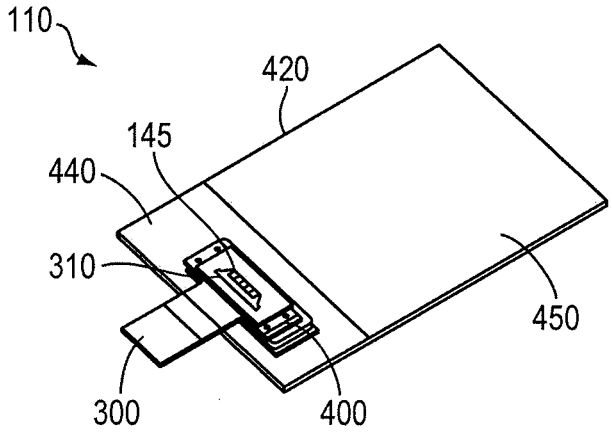

FIGS. 4A and 4B depict bottom and top views, respectively, of an exemplary embodiment of illumination unit 110. As pictured, a sub-assembly 400 includes one or more LEDs 145 mounted on carrier 310, which is in turn mounted on PCB 300. Sub-assembly 400 may also include one or more electrical connectors 410 that facilitate electrical communication between the elements of illumination unit 110 and other components, e.g., other illumination units and/or system-level controller 105. Illumination unit 110 may be attached to another portion of illumination system 100 (e.g., another illumination unit 110) via mechanical mount 430, which may also incorporate a heat sink or heat spreader to conduct away heat from, e.g., carrier 310 and/or LEDs 145. Light guide 420 may include a discrete in-coupling region 440, in which light emitted from LEDs 145 is received, spread, and/or mixed to obtain a desired color gamut, as well as a discrete out-coupling region 450, from which the mixed light is emitted. The light emitted from out-coupling region 450 may be substantially uniform over the entire area thereof. Sub-assembly 400 and light guide 420 may incorporate any of the features described in, e.g., U.S. Patent Application Publication Nos. 2009/0225565, 2009/0161361, and 2009/0161369, the entire disclosures of which are incorporated by reference herein.

Figure 5:
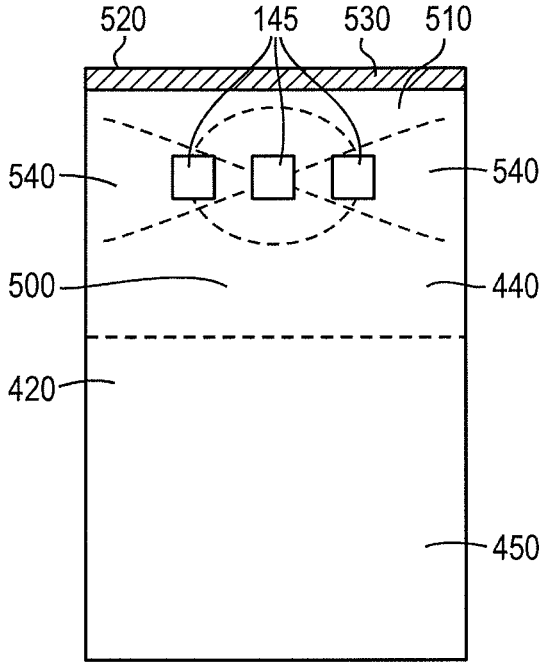
FIG. 5 is a schematic top view of components of an illumination element in accordance with various embodiments of the invention.

Generally, a sensor 155 (or multiple sensors 155, if so utilized in an individual illumination unit 110) is located on sub-assembly 400 in a location where it receives light from each of the LEDs 145 on sub-assembly 400. However, it is also often desirable to position the sensor 155 such that it interferes minimally with the propagation of the light emitted by the LEDs 145 in the in-coupling region 440 into the out-coupling region 450. FIG. 5 illustrates an exemplary arrangement of LEDs 145 in an in-coupling region 440 and the distribution of light emitted therefrom. Region 500 contains light emitted at least substantially directly from LEDs 145 toward and into the out-coupling region 450, while region 510 contains light emitted by LEDs 145 toward a back surface 520 of light guide 420. A mirror 530 may be located at back surface 520 to reflect at least a substantial portion of the light striking it back toward out-coupling region 450. Regions 540 contain light emitted from LEDs 145 that is at least partially "shadowed" by one or more of the LEDs themselves. Further, light in regions 540 emitted substantially perpendicular to a side of light guide 420 may not propagate to the out-coupling region 450, even if reflected by a mirror. Thus, it is generally preferable to position sensor 155 in a region 540 or region 510, i.e., outside of the direct "line-of-sight" between an LED 145 and the out-coupling region 450. While FIG. 4 depicts three LEDs 145 (e.g., a red LED, a green LED, and a blue LED) positioned in a substantially horizontal line (i.e., perpendicular to the direct line-of-sight between the LEDs 145 and the out-coupling region 450), other configurations and/or numbers of LEDs are possible and still result in the above-described regions of emitted light. In a preferred embodiment (like that depicted in FIGS. 6A, 6B, and 6C), five LEDs 145 are positioned in a substantially horizontal line and arranged symmetrically by color about the center point of the line, e.g., the center LED 145 emits blue light, the two immediately to its left and right emit green light, and the two on the ends of the row emit red light.

Figure 6A:
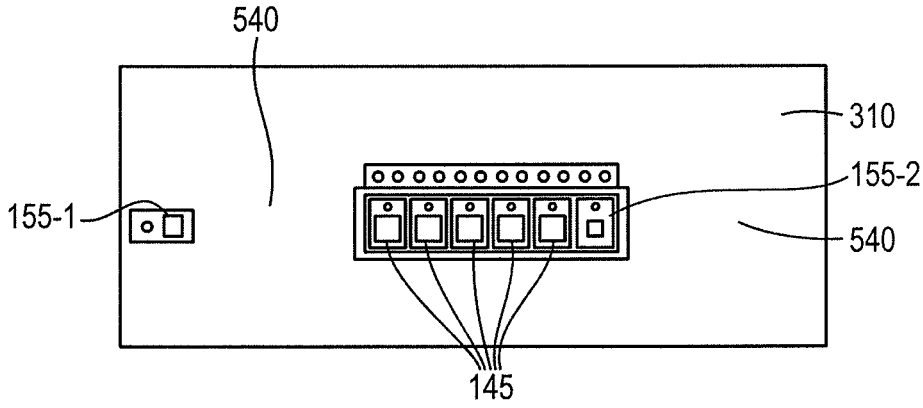
FIGS. 6A, 6B, and 6C are top views of sub-assemblies incorporating LEDs and sensors in various configurations in accordance with embodiments of the invention.
Figure 6B:
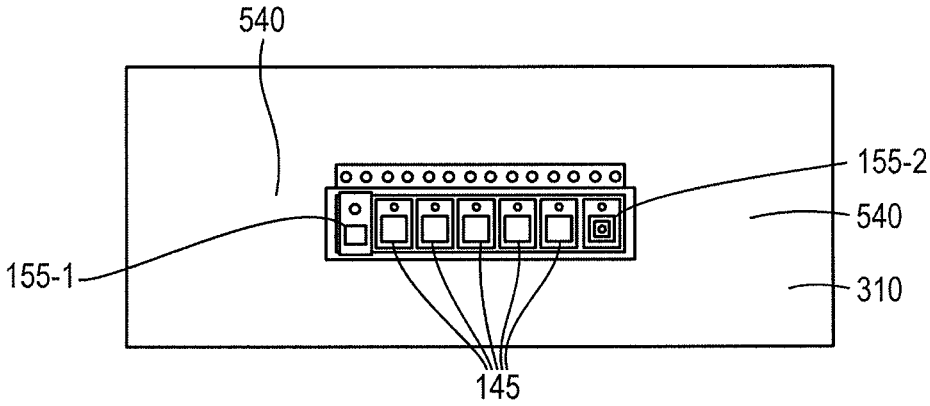
Figure 6C:
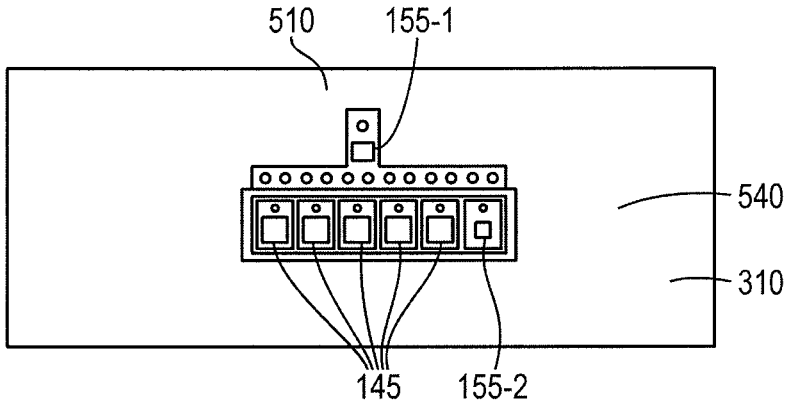

FIGS. 6A, 6B, and 6C illustrate exemplary configurations of LEDs 145 and sensors 155 that interfere only minimally (if at all) with propagation of light to an out-coupling region 450 and out of an illumination unit 110. In any of the depicted configurations, both the LED(s) 145 and the sensor(s) 155 (e.g., an intensity sensor 155-1 and a temperature sensor 155-2) may be located on a sub-assembly 400 and within the in-coupling region 440 of a light guide 420. In FIG. 6A, an intensity sensor 155-1 is located in region 540 at some distance away from but substantially collinear with a row of LEDs 145 (as shown in FIG. 5, a sensor 155 need not be collinear with the row of LEDs 145 to be within region 540). Thus, the sensor 155-1 is positioned substantially perpendicular to the direct line-of-sight between the LEDs 145 and the out-coupling region 450 (not pictured in FIGS. 6A, 6B, and 6C). A temperature sensor 155-2 is also located in region 540 but closer to the row of LEDs 145 in order to facilitate more accurate measurement of the temperature of LEDs 145.

FIG. 6B depicts a similar configuration in which two sensors 155, e.g., intensity sensor 155-1 and temperature sensor 155-2, are disposed at opposing ends of a row of LEDs 145. In this configuration, the sensors 155 are located in regions 540 and enable the symmetric propagation of light from the row of LEDs 145 within the in-coupling region 440 and into the out-coupling region 450. Specifically, each sensor 155 has a substantially similar shadowing effect on the light emitted from the LEDs 145, resulting in a symmetric light distribution into and out of out-coupling region 450 (which may even be symmetric by color, particularly if the row of LEDs 145 is arranged symmetrically by color as described above).

While the locations of sensors 155 depicted in FIGS. 6A and 6B enable minimal interference with light propagation, they may also result in large variations of the amount of light received at the sensor 155 from each LED 145 when multiple LEDs 145 are utilized. Thus, sensors 155 located in regions 540 (e.g., intensity sensors 155-1) preferably have a large dynamic range, e.g., a dynamic range greater than approximately 10, greater than approximately 20, or even approximately 30 or more. In some embodiments, in order to ensure sufficient light flux reaching an intensity sensor 155, the LED(s) 145 may be driven at a specific time or with specific illumination parameters substantially different from the nominal illumination parameters (i.e., parameters suitable for the particular application of illumination unit 110). For example, the LED(s) 145 may be operated during the ignition period or shutdown period of illumination system 100, or at any time when the illumination parameters are not required by the application.

In FIG. 6C, an intensity sensor 155-1 is located in region 510, i.e., the LEDs 145 are located between the sensor 155 and the out-coupling region 450. As depicted, LEDs 145 are again arranged in a substantially horizontal row, and intensity sensor 155-1 is located behind and substantially at the center point of the row. A temperature sensor 155-2 is located close to and at the end of the row of LEDs 145, as in FIGS. 6A and 6B. In such a configuration, the intensity sensor 155-1 receives approximately symmetric amounts of light from the different locations in the row of LEDs 145, i.e., approximately the same amount of light from each of the LEDs 145 on either end of the row, etc. Thus, in such a configuration, the intensity sensor 155-1 may not require as large a dynamic range as in the configurations described above. In an embodiment, the sensor 155 has a dynamic range less than approximately 15, or even approximately 10 or less.

Although FIGS. 6A, 6B, and 6C each depict temperature sensor 155-2 in close proximity to LEDs 145, it may also be placed more remotely, e.g., behind the LEDs 145 like intensity sensor 155-1 in FIG. 6C, or in another location on carrier 310 or sub-assembly 400 (e.g., on a shared heat sink). Preferably the temperature sensor 155-2 is in good thermal contact with LEDs 145 in order to facilitate accurate temperature readings thereof. Depending on the location of temperature sensor 155-2, an estimated or measured offset may be utilized to compensate for heat loss between the locations of an LED 145 and temperature sensor 155-2.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. An illumination system comprising:

a plurality of LED units, each LED unit comprising a plurality of differently colored, independently controllable LEDs forming a color gamut;

a system controller for generating control signals for each of the LED units consistent with a desired system-level output;

at least one sensing unit for sensing an operating state of the LEDs during operation thereof;

a plurality of local controllers each associated with at least one LED unit, each local controller comprising a memory and a compensator, wherein:

the memory comprises calibration data for use over a short time period, the compensator updates the calibration data based on measurements from a sensing unit over a long time period longer than the short time period, based at least in part on the calibration data, the local controller operates the LEDs of the LED unit to maintain output intensities consistent with commands issued by the system controller, and the calibration data comprises in-cycle calibration data and long-term calibration data, the in-cycle calibration data being used by the local controller over a single cycle between activation and de-activation of the LED unit, and the long-term calibration data being used by the local controller to adjust a baseline current level to each of the LEDs.

2. The system of claim 1, wherein each of the LED units has a separate sensing unit.

3. The system of claim 2, wherein the at least one sensing unit senses temperature.

4. The system of claim 2, wherein the at least one sensing unit senses intensity.

5. The system of claim 2, wherein the at least one sensing unit senses color.

6. The system of claim 1, wherein each local controller comprises a pulse-width modulation decoder for decoding signals received from the system controller.

7. The system of claim 1, wherein, during the cycle, the local controller uses pulse-width modulation to adjust the outputs of the LEDs based on the in-cycle calibration data.

8. The system of claim 1, wherein, during the cycle, the local controller adjusts the outputs of the LEDs based on the in-cycle calibration data and a temperature of each LED measured by the at least one sensing unit.

9. The system of claim 1, wherein the compensator determines a cycle-to-cycle trend based on prior cycles and extrapolates the trend to a current cycle.

10. The system of claim 9, wherein the compensator updates the long-term calibration data prior to the current cycle.

11. The system of claim 1, wherein the compensator determines a cycle-to-cycle trend based on prior cycles and a current cycle, and extrapolates the trend to a subsequent cycle.

12. The system of claim 11, wherein the compensator updates the long-term calibration data following the current cycle.

13. The system of claim 1, wherein at least one LED unit comprises at least one red LED, at least one green LED, at least one blue LED, and at least one amber LED, the at least one LED unit outputting tunable white light.

14. The system of claim 1, wherein at least two LED units comprise substantially unbinned LEDs and emit substantially identical output light.

15. A method of illumination, the method comprising:

providing an LED unit comprising a plurality of differently colored, independently controllable LEDs forming a color gamut;

utilizing in-cycle calibration data over a single cycle between activation and de-activation of the LED unit to maintain a consistent output intensity; and adjusting a baseline current level to each of the LEDs based on long-term calibration data to maintain the consistent output intensity.

16. The method of claim 15, further comprising:

providing at least one additional LED unit comprising a plurality of differently colored, independently controllable LEDs forming a color gamut; and generating control signals for the LED unit and the at least one additional LED unit consistent with a desired system-level output.

17. The method of claim 15, wherein, during the cycle, pulse-width modulation is used to adjust the outputs of the LEDs based on the in-cycle calibration data.

18. The method of claim 15, wherein, during the cycle, the outputs of the LEDs are adjusted based on the in-cycle calibration data and a sensed temperature of each LED.

19. The method of claim 15, wherein a cycle-to-cycle trend based on prior cycles is extrapolated to a current cycle.

20. The method of claim 19, the long-term calibration data is updated prior to the current cycle.

21. The method of claim 15, wherein a cycle-to-cycle trend is determined based on prior cycles and a current cycle, the trend being extrapolated to a subsequent cycle.

22. The method of claim 21, wherein the long-term calibration data is updated following the current cycle.

23. The method of claim 16, wherein the control signals comprise pulse-width modulation signals, further comprising decoding the control signals.

24. The method of claim 16, wherein the LED unit and the at least one additional LED unit comprise substantially unbinned LEDs and emit substantially identical output light.

* * * * *